United States Patent [19]

Naifeh

[11] 4,190,953

[45] Mar. 4, 1980

[54] ADJUSTABLE SPRING TENSION POCKETKNIFE

[76] Inventor: Woodrow W. Naifeh, Rte. 13, Box 380, Tulsa, Okla. 74107

[21] Appl. No.: 899,502

[22] Filed: Apr. 24, 1978

[51] Int. Cl.[2] ..... B26B 1/02

[52] U.S. Cl. ..... 30/155

[58] Field of Search ..... 30/155, 156, 157, 158, 30/159, 160, 161, 152

[56] References Cited

U.S. PATENT DOCUMENTS

| | | | |
|---|---|---|---|
| 400,987 | 4/1889 | Wilzin | 30/159 |
| 689,513 | 12/1901 | Papendell | 30/158 |
| 988,068 | 3/1911 | Beardsley | 30/152 |

FOREIGN PATENT DOCUMENTS

| | | | |
|---|---|---|---|
| 954845 | 1/1950 | France | 30/159 |

*Primary Examiner*—Robert Louis Spruill
*Assistant Examiner*—W. D. Bray
*Attorney, Agent, or Firm*—James H. Chafin

[57] ABSTRACT

A folding blade pocketknife having a pivotally mounted leaf-type spring, one end of the spring being in contact with a cam surface of a pivotally mounted blade, the opposite end of the spring being in contact with a moveable surface, said moveable surface being adjustable for adjusting the effective tension of the knife blade.

5 Claims, 4 Drawing Figures

ADJUSTABLE SPRING TENSION POCKETKNIFE

BACKGROUND OF THE INVENTION

1. Field of the Invention

The present invention relates to cutlery and more particularly but not by way of limitation to a folding blade pocketknife having an infinitely adjustable leaf spring.

2. History of the Prior Art

The standard folding blade pocketknife is provided with a leaf spring which is pinned or riveted between two handle plates. The pin or rivet mounting normally comprises a pin through the center of the spring and through one end thereof. The free end of the spring is placed in sliding contact with a cam surface associated with a pivotally mounted blade.

The blade member is connected between the handle plates at one end thereof so that when the knife is closed, the cutting edge is recessed between the handle plates.

The pivotally mounted end of the knife blade has a cam surface which is in constant sliding engagement with the free end of the leaf spring. The shape of this cam surface varies from knife to knife but it is normally of a rectangular configuration having rounded corners. The cam surface has a first flattened portion which is in engagement with the spring when the knife is open and tends to hold the blade in the open position. The opposite side of the cam surface is also flattened in order to tend to hold the blade in a closed position.

Most knives are manufactured with a rather heavy spring tension. However, the heavy spring configuration prevents many young people and ladies from being able to use a standard knife since they are either unable to open the knife or in opening the knife thumbnails are broken or damaged. One reason for manufacturing a knife with heavy spring tension is that after extended use, the cam surface becomes worn and/or the spring becomes weakened such that there is little or no spring tension to hold the blade in either the open or closed position.

One recent configuration of a pocketknife or folding blade hunting knife provides very little spring tension, but which firmly locks into the open position during use. In order to close such knives, it is required that the user depress a latch mechanism while simultaneously folding the blade into the handle. While this knife has obvious safety features, it normally requires both hands to close which is undesirable for many uses.

The pocketknife art is replete with foldable closing pocketknives having various mechanisms including removeable pins, cam locks and the like which disengage one of the spring fasteners in order to completely release the spring tension on the foldable blade so that the blade member may be removed and replaced. However, this does not solve the problem addressed by the present invention.

SUMMARY OF THE PRESENT INVENTION

The present invention provides a folding blade pocketknife designed and constructed to provide adjustability of the spring tension over a broad range.

The knife is provided with a leaf-type spring which is pivotally connected near the center thereof between the handle plates by a rivet or other permanent pin mounting.

One end of the knife handle is simply provided with a typically constructed blade pivotally connected between the handle plates, the portion of the blade about the pivot point being provided with a cam surface similar to that hereinbefore described. The opposite end of the knife handle assembly is provided a plate member permanently mounted between the handle plates. This plate member is provided with a threaded bore therethrough, the bore lying in the plane of the knife blade and transverse to the spring member.

A recessed set screw is threadedly disposed in the bore and is moveable into contact with the end of the leaf spring. The opposite end of that set screw is slotted so that it may be rotated with a small screwdriver, hair pin or the like. When the set screw is moved in a direction toward the spring, the spring member is rotated so that the end of the spring in contact with the cam surface of the blade is forced against that cam surface with greater force. On the other hand, when the set screw is backed in a direction away from the spring member, the force of contact between the spring member and the cam surface is relaxed thereby effectively relaxing spring tension. Hence, the user may adjust the knife blade to any desired spring tension within the range provided by the physical size limitations of the knife.

After the knife has become worn and the spring tension relaxes somewhat, a simple manipulation of the set screw will restore the knife back to its original spring tension and thereby extend the effective life of the pocketknife.

Therefore, a single design pocketknife may be constructed in the manner described and then be adjusted to fit the needs of substantially any user.

DESCRIPTION OF THE DRAWINGS

Other and further advantageous features of the present invention will hereinafter more fully appear in connection with the detailed description of the drawings in which.

Figure 1:
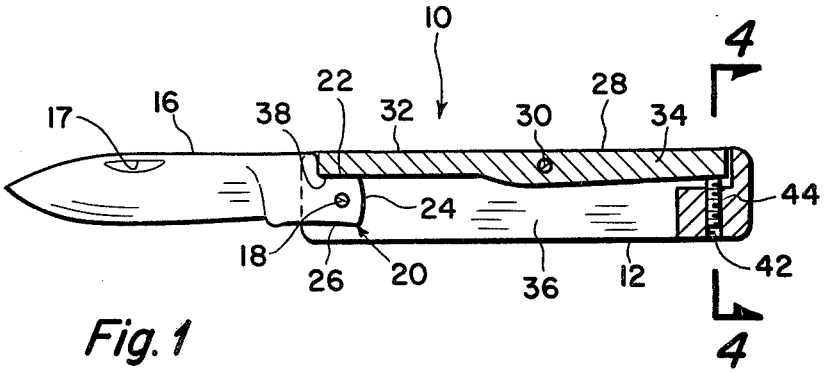
FIG. 1 is a side elevational view, partially in section, of a knife embodying the present invention, the knife being in an open position.

Referring to the drawings in detail, reference character 10 generally describes a folding blade pocketknife comprising a pair of spaced apart parallel handle plates 12 and 14 and a cutting blade member 16 which is pivotally mounted between the handle plates 12 and 14 near one end thereof by the pivot pin 18. The end portion of the blade 16 surrounding the pivot pin is provided with a cam surface generally indicated by reference character 20 having a first flattened portion 22. An oppositely disposed flattened portion 26 and an end flattened portion 24, the corners between the flattened portions being rounder.

The knife further comprises an elongated leaf-type spring member 28 which is pivotally connected between the handle members 12 and 14 and near the center of the spring member by the pivot pin 30.

Figure 2:
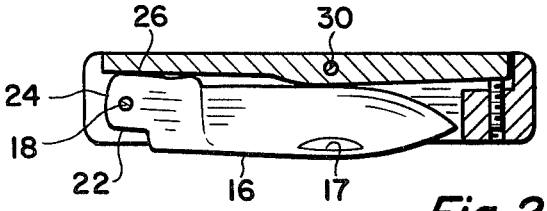
FIG. 2 is a side elevational view, of the knife of FIG. 1 in a closed position.

Further, the spring member is attached to the handle between the handle plates and along one edge thereof which provides a cavity 36 between the handle members for receiving the blade 16 therein when in a closed position as shown in FIG. 2.

The spring member 28 is constructed of a spring steel type material with one end portion 32 being somewhat thinner than the opposite end portion 34 for a reason that will be hereinafter set forth. The inside end portion 38 of the spring member 28 is disposed in sliding engagement with the cam surface 20 of the knife blade.

An end plate member 40 is secured between the handle plates 12 and 14 opposite the knife blade and is secured to said handle members by means of silver solder, welding, riveting or in any well known manner. An elongated threaded bore 42 is provided through the plate member 40, the bore being substantially transverse to the elongated spring member 28 and perpendicular to the spring member pivot pin 30.

Figure 4:
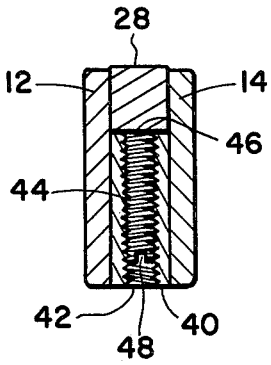
FIG. 4 is an end sectional view of the knife taken along the broken lines 4—4 of FIG. 1.

An elongated set screw 44 is threadedly disposed in the bore 42 and the inner end 46 of the set screw is in contact with one end of the leaf spring 28 as particularly shown in FIG. 4 of the drawings. The opposite end of the set screw 44 is provided with a slot or other recess 48 for receiving a screwdriver type tool (not shown) therein.

It can be readily seen that when the set screw 44 is moved toward the spring member 28, the spring member 28 is pivoted so that the surface portion 38 thereof exerts a stronger force on the cam surface 20 of the knife blade 16. Conversely, when the set screw 44 is moved in a direction away from the spring member 28, the force that the surface 38 exerts on the cam 20 is lessened.

Figure 3:
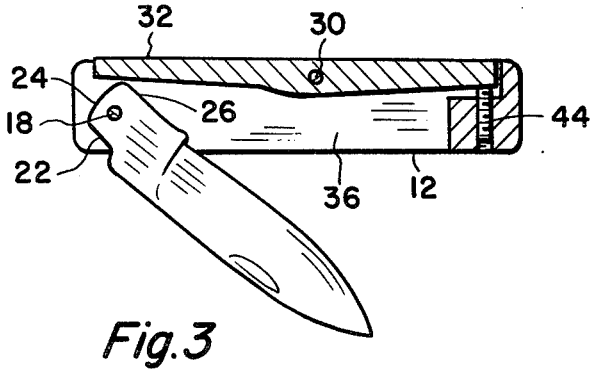
FIG. 3 is a side elevation of the knife of FIG. 1 in a partially open position.

It can be seen that when the knife is in an open position, the cam surface 22 is in contact with the end portion 38 of the spring member which tends to hold the blade 16 in the open position. Upon closing the blade, the knife blade is rotated so that the corner of the cam surface between the flattened portions 22 and 24 must overcome the leaf spring whereby some relaxation occurs while the spring member is in contact with the flattened portion 24 which is known as the safety position (not shown). As the knife blade moves past the safety position, so that the corner separating the cam surface 24 and 26 again forces the spring end outwardly as shown in FIG. 3 whereby after the knife blade is closed as shown in FIG. 2, the flattened cam surface 26 is in contact with the spring member which helps hold the blade in a closed position.

Conversely, it can be seen that to open the knife blade the user inserts his thumbnail in the slot groove 17 and pulls the knife blade open which forces the leaf spring portion 32 outwardly so that the surface portion 38 of the spring member again acts as a cam follower. It is during this opening operation that fingernails are damaged or the blade is difficult to open due to the spring tension being too heavy. Therefore, the set screw 44 may be infinitely adjustable to set the spring tension so that it is in a desirable range for any particular user. Likewise, when the cam surface 20 becomes worn or the spring changes its return characteristics due to age and use, the set screw 44 may be again adjusted to the desirable spring tension. The set screw will tend to stay in any given position since the end of the spring member is in constant pressure thereagainst.

The spring effect is provided by the cross-sectional size of the free end of the spring. Since the opposite end of the spring is of a larger cross-section, very little bending takes place. Hence, the actual spring effect provided by the leaf spring is not changed by the present invention. The present invention simply pivotally orients the leaf spring into a position to provide the desired force resistance.

From the foregoing it is apparent that the present invention provides a single design pocket folding blade pocketknife in which the spring tension may be adjusted to any desired amount to fit the needs of an individual user.

Whereas, the present invention has been described in particular relation to the drawings attached hereto, other and further modifications apart from those shown or suggested herein may be made within the spirit and scope of the invention.

What is claimed is:

1. In a folding blade knife having an elongated handle member, at least one knife blade having a cam surface portion pivotally secured to one end of the handle member and an elongated leaf spring member carried along one edge of the handle member with a first end thereof in yieldable engagement with said cam surface portion of the knife blade, the improvement comprising:

(a) said leaf spring member being pivotally attached to the handle member near the center of said leaf spring member; and (b) means carried by the handle member and movably engageable with the second end of the leaf spring member, said means comprising a plate member having a threaded bore therethrough, said bore being transverse to the spring member and perpendicular to the pivotal axis thereof and a set screw threadedly disposed in said bore, one end thereof being engageable with the second end of the spring member for pivotally moving said spring member to adjust the force of the first end of the spring member against the knife blade cam surface.

2. An improvement in a folding blade knife as set forth in claim 1 wherein the opposite end of the set screw is slotted for facilitating rotation thereof within the bore.

3. An improvement in a folding blade knife having a pair of spaced apart elongated handle members, a knife blade having one end pivotally attached between the handle members at one end thereof, said blade having a cam surface partially surrounding the pivotal attachment, the improvement comprising:

an elongated leaf spring member pivotally attached near its midpoint between the handle members and along one edge thereof, one end of said spring member being in constant engagement with the blade cam surface, an end plate secured between the handle members at the end opposite the knife blade attachment, a threaded bore provided through the end plate substantially transverse to the spring member and perpendicular to the pivotal axis of the spring member, a recessed set screw threadably disposed in the bore, one end thereof being contactable with the end of the spring member.

4. In a folding blade knife having an elongated handle member, at least one knife blade having a cam surface portion pivotally secured to one end of the handle member and an elongated leaf spring member carried along one edge of the handle member with a first end thereof in yieldable engagement with said cam surface portion of the knife blade, the improvement comprising:

(a) said leaf spring member being pivotally attached to the handle member near the center of said leaf spring member; and (b) tension adjustment means carried by the handle member and movably engageable with the second end of the leaf spring member for pivotally moving said leaf spring member to adjust the force of the first end of the leaf spring member against the knife blade cam surface, said tension adjustment means being selectively setable in a range containing a number of desired positions to produce a desired effective spring tension without interference with the use of the knife.

5. In a folding blade knife having an elongated handle member, at least one knife blade having a cam surface portion pivotally secured to one end of the handle member and an elongated leaf spring member carried along one edge of the handle member with a first end thereof in yieldable engagement with said cam surface portion of the knife blade, the improvement comprising:

(a) said leaf spring member being pivotally attached to the handle member near the center of said leaf spring member; and (b) tension adjustment means carried by the handle member and movably engageable with the second end of the leaf spring member, said tension adjustment means being selectively setable within a range containing a number of desired positions to produce a desired effective spring tension, said tension adjustment means being completely recessed within the handle member for preventing interference with the use of the knife.

* * * * *